United States Patent [19]

Peterson et al.

[11] 3,941,057

[45] Mar. 2, 1976

[54] ARMOR PIERCING PROJECTILE

[75] Inventors: Albert H. Peterson, Salt Lake City; Howard L. Peterson, Bountiful, both of Utah

[73] Assignee: Hercules Incorporated, Wilmington, Del.

[22] Filed: Oct. 9, 1974

[21] Appl. No.: 513,369

Related U.S. Application Data

[63] Continuation-in-part of Ser. No. 347,742, April 4, 1973, abandoned.

[52] U.S. Cl. ..... 102/52; 102/66

[51] Int. Cl.[2] ..... F42B 13/06; F42B 13/14

[58] Field of Search ..... 102/52, 66, 90

[56] References Cited

UNITED STATES PATENTS

| | | | |
|---|---|---|---|
| 1,294,329 | 2/1919 | Bowers | 102/52 |
| 2,724,334 | 11/1955 | Norton et al. | 102/52 |
| 3,096,715 | 7/1963 | Dufour | 102/52 |
| 3,302,570 | 2/1967 | Marquardt | 102/52 |
| 3,507,221 | 4/1970 | Grolly | 102/52 |

FOREIGN PATENTS OR APPLICATIONS

| | | | |
|---|---|---|---|
| 819,445 | 8/1969 | Canada | 102/52 |

*Primary Examiner*—Verlin R. Pendegrass
*Attorney, Agent, or Firm*—James W. Peterson

[57] ABSTRACT

The invention is an armor piercing incendiary spin stabilized projectile.

6 Claims, 1 Drawing Figure

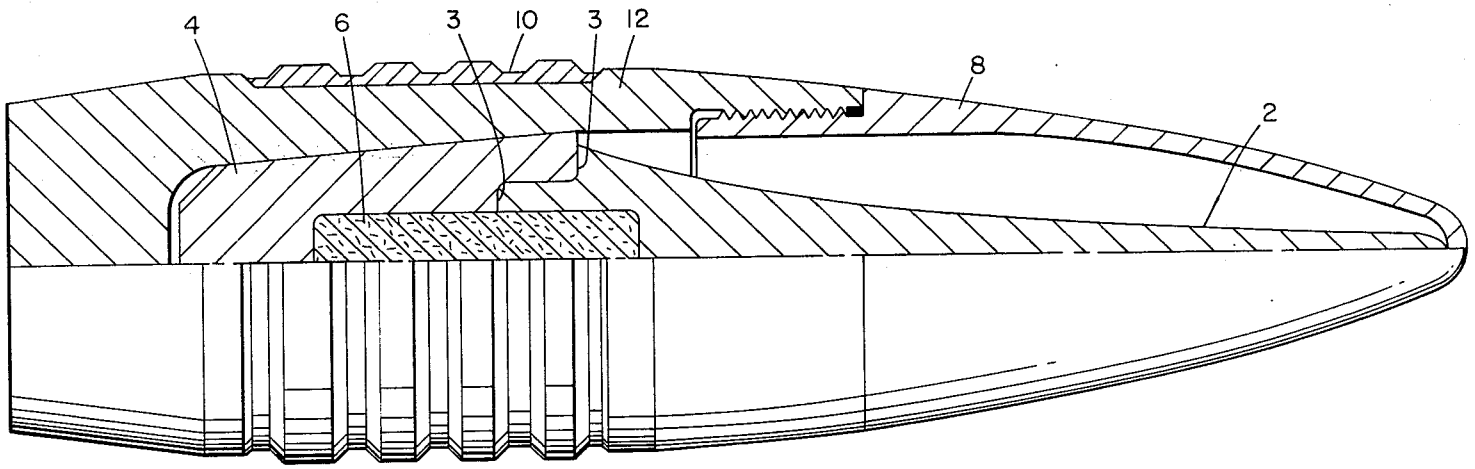
2
8
12
3
10
3
6
4

ARMOR PIERCING PROJECTILE

This is a continuation-in-part of U.S. patent application Ser. No. 347,742, filed Apr. 4, 1973, and now abandoned.

BACKGROUND OF THE INVENTION

An armor piercing projectile comprises a projectile body, a penetrator and a windshield. Subcaliber penetrators are used in armor piercing projectiles to obtain increased penetration performance compared to a penetrator round of full diameter. The conventional design of the subcaliber penetrator is a cylinder having a length-to-diameter ratio in the range of 6 to 8 with various nose shape configurations, including ogival, conical, and double conical. The reason that penetration performance is improved by the subcaliber penetrator is that more energy per unit area can be applied at the target. Maximum performance is achieved in conventional subcaliber penetrator designs by using the highest density materials for the penetrator which maximizes the energy per unit area.

In spin stabilized ammunition, a limit is reached on the allowable length-to-diameter ratio for the penetrator because of the increased spin required to stabilize the longer penetrators. Because the length for a given diameter is limited, the energy per unit area of the penetrator is also limited for a given penetrator material. The present invention provides a special design of the subcaliber penetrator which removes the performance limitation discussed above and allows the design of penetrator rounds within stability limitations that deliver higher energy per unit area at the target than do conventionally designed subcaliber rounds for the same stability restraints.

The gyroscopic stability factor of a projectile is directly proportional to the quotient of the axial moment of inertia squared divided by the transverse moment of inertia:

$$S_G = K \left(\frac{I_a^2}{I_t}\right)$$

where $S_G$ = stability factor (must be greater than one for gyroscopic stability)

$K$ = proportionality constant (can be considered constant only if comparing projectiles of identical exterior shape and total weight)

$I_a$ = axial moment of inertia $I_t$ = transverse moment of inertia

The difference between the invention and conventionally designed subcaliber penetrators can be shown by analysis of the above equation. For the conventional subcaliber penetrator the length-to-diameter ratio and, therefore, the energy per unit area at target impact is limited by the moment of inertia considerations. The smaller diameter of the conventional subcaliber penetrator reduces $I_a^2$ and the increased penetrator length increases $I_t$; both changes are cumulative and reduce $S_G$. The penetrator of the instant invention has a maximum length-to-diameter ratio of 5:1 and has a shape whose envelope from tip to base is substantially defined by an exponential curve of revolution about its longitudinal axis. Said exponential curve of revolution is described by the formula:

$$Y = a + b\,x^N$$

$Y$ = radial distance from longitudinal axis $a$ /$b$ ı $b$ are constants $x$ = distance measured from the tip $N$ = exponent defining the curved shape The exponent range for the invention must be greater than one and thus the surface is concave. Conventional subcaliber penetrators have the conical or ogival shape which could also be defined by the exponential curve of revolution, however, the exponent would be one or less and, therefore, the surface would be conical or convex rather than concave. It has been found that conventional designs having length-to-diameter ratios greater than 5 tp 1 have undesirable stability characteristics. In the penetrator shape of the instant invention, the material toward the base that is at a larger diameter than the forward tip nose section acts to increase the axial moment, $I_a$ as compared to the condition where this material was added to the base at the same diameter (as in a conventional high L/D projectile). The position of this material also is closer to the center of gravity of the projectile. Thus the transverse moment of inertia ($I_t$) is reduced. Both moment changes according to the above equation, increase the stability factor, $S_G$, over the conventional high L/D projectile. The invention gives performance at the target of a high length-to-diameter ratio penetrator, however, the actual moment of inertia considerations do not degrade the stability of the projectile because of its special design.

OBJECT OF THE INVENTION

It is a primary object of the instant invention to provide a spin stabilized armor penetrating projectile with maximum penetration performance.

SUMMARY OF THE INVENTION

The purpose of this invention is to provide a configuration of a spin stabilized armor penetrating projectile with maximum penetration performance. To achieve this purpose the present invention provides a subcaliber penetrator, having a length-to-diameter ratio no greater than 5:1, the form of said penetrator being defined substantially by the envelope described by an exponential curve of revolution about its axis from tip to base, the exponent of said curve being greater than one, in combination with a steel windshield to provide a low drag contour, an aluminum support for the penetrator, and a steel body with a plastic rotating band.

DESCRIPTION OF THE DRAWING

The FIGURE shows an armor piercing incendiary projectile in half section.

DESCRIPTION OF THE PREFERRED EMBODIMENT

This invention applies to armor piercing or armor piercing incendiary spin stablized projectile designs used typically by the military in calibers (diameter sizes) 20 mm. or larger. With continued reference to the drawing the figure depicts an armor piercing incendiary design where the special design of the penetrator 2 and the support 4 provides effective transfer of energy from the more massive body 12 to the base of the subcaliber penetrator 2. This energy transfer is made possible by the comparatively large contact area 3 between the base of the penetrator 2 and the support 4. The design of the support 4 utilizes a ductile metal such as aluminum in order to apply forces to the penetrator base during the energy transfer at target impact. Under the shock of impact a ductile material at the base of the penetrator maintains pressure on the penetrator rather than breaking up and flowing radially. Mass remains concentrated at center for longer period of time during penetration.

The special design of the penetrator as seen in the FIGURE is due to its length-to-diameter ratio being no greater than 5:1 and its form being substantially defined by the envelope described by an exponential curve of revolution about its axis from tip to base. The exponential curve of revolution is described by the formula discussed previously and would have an exponent greater than one, i.e., the surface would be concave producing a shape having improved penetration performance. The tip of the penetrator may be pointed to a greater or lesser extent as long as the overall form of the penetrator is maintained as described previously.

The base of the penetrator 2 is counter-bored to provide a cavity for a metallic incendiary composition 6. Elimination of the incendiary composition does not significantly change penetration performance since the contact area or weight distribution is only minimally altered and the base of the penetrator is stronger structurally. The optimum shape of the penetrator 2 within the envelope previously described can be determined by appropriate analyses and tests with particular target, projectile, and typical impact conditions, including angle of impact and velocity at impact. The description above illustrates a design scheme rather than a specific detailed design configuration.

Assuming that a high percentage of total round kinetic energy is transferred to the subcaliber penetrator, the penetration performance of the armor piercing projectile of this invention is not significantly improved by more dense penetrator materials for a fixed total round weight. The use of light, strong composites offer the possibility of maximizing penetration performance within specified stability and round weight limits. Carbon fiber-carbon matrix or boron fiber-carbon matrix composite materials may be used for optimum penetration configuration. The use of tungsten alloy or depleted uranium as penetrator materials are likewise advantageous against spaced armor or targets at or greater. obliquities. A highly oblique target is considered to be a condition where the angle between the projectile trajectory and line normal to the target is 60° greater.

The remaining components of the armor piercing projectile of this invention are a windshield 8 and a rotating band 10. The configuration illustrated depicts an ogival windshield 8 to provide a low drag profile. The rotating band 10 may also vary in design without significantly affecting penetration performance. The band design can be conventionally swaged, overlay welded or plastic since the function of the band is obturating and in transferring torque to the body for spin stabilization. A rotating band other than a swaged type would be preferable since providing grooves in the body for the swaged band would degrade structural integrity of the body as a pressure vessel and, thus, result in decreased penetration performance.

The resulting projectile provides an excellent transfer of energy from the body of the projectile through the ductile aluminum to the base of the steel penetrator. The support of the penetrator by a ductile material enhances performance on oblique targets. An oblique target is a target where impact is not directly normal to the projectile trajectory. This type of target tries to bend the penetrator during penetration and sometimes causes structural failure of the penetrator (commonly referred to as shatter). The aluminum support will become molten in the high stress during penetration and when a side force moves the penetrator during penetration, the energy transfer continues to be applied axially because of the fluid pressure. Because the penetrator support acts like a fluid, the force on the base of the penetrator is maintained for a longer period of time during penetration which results in increased depth of penetration. The instant design provides maximum performance with given projectile weight and stability constraints. The inventive design scheme offers savings in material weight and/or improved performance in other parts of the gun system because of the greater penetration performance potential of the invention. The increased depth of penetration offered by this design scheme is achieved primarily because of the shape of the penetrator and its support. The smaller forward diameter requires less energy for penetration than a conventional penetrator of the same weight that has the equivalent stability characteristics. Penetration performance can be improved by this invention in any gun system using spin stabilized ammunition.

Although the foregoing description has been directed to the preferred embodiments of the invention, it is noted that other variations and modifications may be made without departing from the spirit and scope of the invention as defined by the claims appended hereto.

What we claim and desire to protect by Letters Patent is:

1. An armor piercing incendiary projectile comprising:

body means;

penetrator means contained within said body means, said penetrator means having a maximum length-to-diameter ratio of 5:1, said penetrator means having a tip and a base, the shape of said penetrator means being an envelope from tip to base substantially defined by an exponential curve of revolution about its longitudinal axis, the exponent of said curve being greater than one, said shape providing weight distribution that increases the mass on the outer periphery of the penetrator to maximize the polar moment of inertia to provide favorable stability characteristics;

support means interconnecting said body means and said penetrator means, said support means being made from a ductile metal;

wind cover means surrounding said penetrator means and connected to said body means to provide a low drag profile; and band means circumferentially mounted over said body means to spin stabilize the projectile.

2. A device as in claim 1 further including incendiary means positioned between said penetrator means and said support means, said incendiary means activated upon impact to further assist in penetration and target defeat by fire.

3. A device as in claim 2 wherein said penetrator means contains a counter-bore and said support means contains a counterbore, said incendiary means inserted within said counter-bores.

4. A device as in claim 3 wherein said penetrator is made of steel.

5. A device as in claim 3 wherein said penetrator is made of tungsten alloy.

6. A device as in claim 3 wherein said penetrator is made of depleted uranium.

* * * * *

UNITED STATES PATENT AND TRADEMARK OFFICE

CERTIFICATE OF CORRECTION

PATENT NO. : 3,941,057

DATED : March 2, 1976

INVENTOR(S) : Albert H. Peterson & Howard L. Peterson

It is certified that error appears in the above-identified patent and that said Letters Patent are hereby corrected as shown below:

Col. 2, line 2 " a/b ʃ b are constants " should read -- a & b are constants --.

Col. 2, line 14 " 5 tp 1 " should read -- 5 to 1 --.

Col. 3, lines 44 & 45 " targets at or greater. obliquities." should read -- targets at high obliquities. --.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*